United States Patent [19]

Cosenza et al.

[11] Patent Number: 4,528,737

[45] Date of Patent: Jul. 16, 1985

[54] ADAPTER FOR POWER TOOL INSTALLATION OF TANGLESS HELICALLY COILED INSERT

[75] Inventors: Frank J. Cosenza, San Pedro; Albert K. Yamamoto, Huntington Beach, both of Calif.

[73] Assignee: Rexnord Inc., Brookfield, Wis.

[21] Appl. No.: 581,840

[22] Filed: Feb. 21, 1984

[51] Int. Cl.[3] ..... B25B 23/08

[52] U.S. Cl. ..... 29/240.5; 81/443

[58] Field of Search ..... 29/240.5; 81/440–445, 81/450

[56] References Cited

U.S. PATENT DOCUMENTS

| | | | |
|---|---|---|---|
| 1,676,755 | 7/1928 | Doherty | 81/443 |
| 2,390,524 | 12/1945 | Eckener | 29/240.5 |
| 2,392,843 | 1/1946 | Eckener | 81/444 |
| 2,832,129 | 4/1958 | Forster | 29/240.5 |

*Primary Examiner*—James L. Jones, Jr.

[57] ABSTRACT

A power-driven insertion tool for a helically coiled wire insert of the type used for tapped holes in parent material that is generally softer than a fastener being screwed into the tapped hole, whereby a mandrel having a threaded lead portion and a pivotal pawl inserted in a groove below the threaded portion so that the pawl engages a recess of the insert, in order that the insert may be screwed into the tapped hole. A sleeve, concentric to the threaded mandrel, maintains the insert's helix angle for a smooth transition into the tapped hole. An adjusting nut adjusts the depth to which an insert may be installed and whereby a free spinning bearing contacts the parent material and automatically reverses the torque of the tool.

2 Claims, 4 Drawing Figures

ADAPTER FOR POWER TOOL INSTALLATION OF TANGLESS HELICALLY COILED INSERT

BACKGROUND OF THE INVENTION

This invention relates to a tool for installing wire coil screw thread inserts and, more particularly, to an improved power-driven installation tool for tangless wire coil inserts.

Tools for the installation of wire coil inserts having at one end a diametrical tang of its end convolution so arranged so that the tang can be gripped by the tool as it projects from the coil for installation into a tapped hole are described, e.g., in U.S. Pat. No. 3,111,751. However, the tools are not compatible with tangless wire coil inserts.

The prior art insertion tools, however, generally comprise complicated devices in which the prewinder, used for contracting the original oversized insert to a smaller diameter, does not permit the insert to properly engage the first threads of the patent material. These prior art devices further do not provide for reversing the torque and removing the mandrel from the insert after it has been installed to its proper predetermined depth.

SUMMARY OF THE INVENTION

The present invention is directed to a power-driven tool for inserting tangless helically coiled inserts in tapped holes and comprises a sleeve member having a rotatable and axially movable mandrel, threaded at one end to receive the insert, insertable therein, a pivotal catch located in a cutout near the threaded end portion of the mandrel for installing the insert in the tapped hole, a helix maintaining retracting sleeve axially movable and circumscribed above the mandrel, and a bearing member fixed to the front of the sleeve member and adapted to contact the parent material and automatically reverse the direction of travel of the mandrel.

Accordingly, it is an object of the present invention to provide a power-driven insertion tool which will drive an insert a predetermined depth into a tapped hole and then automatically reverse the torque to drive the tool out of the tapped hole.

It is another object of the present invention to provide a power-driven insertion tool with a threaded mandrel and pivotal pawl which snaps into the notch located on the lead coil of a tangless wire coil insert, thus minimizing the time required to insert said coiled insert in a tapped hole.

A further object of the present invention is to provide a reliable power-driven installation tool with a minimum of moving parts both for ease of manufacture and ease of use.

A still further object of the present invention is to provide a power-driven installation tool provided with a free spinning bearing on the front of the tool which prevents the tool from jamming against the parent material.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The present invention is particularly adapted for use with tangless coils which are used, for example, where a steel alloyed bolt having conventional threads is desired to be fastened into a material of relatively softer alloy, such as aluminum.

Figure 1:
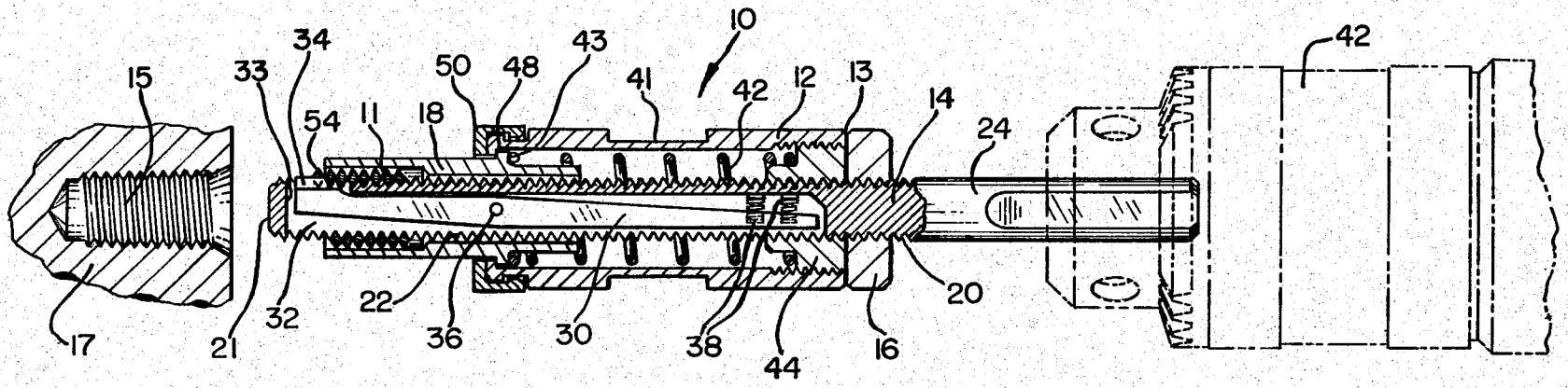
FIG. 1 is a side elevation view, partially broken away, of a tangless helically coiled insert power-driven installation tool, prior to installation of the insert, in accordance with the present invention.
Figure 2:
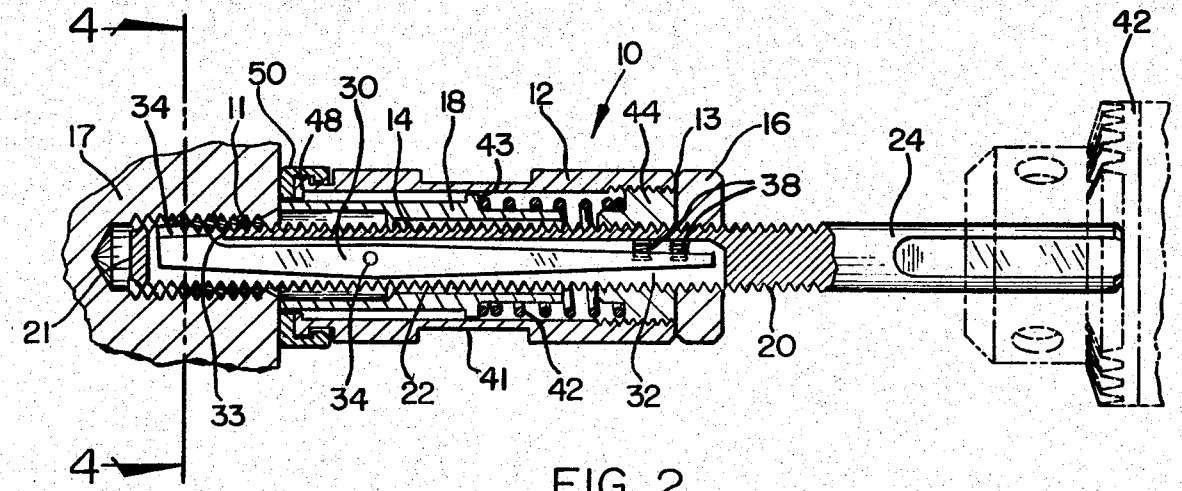
FIG. 2 is a side elevation view, partially broken away, of a tangless helically coiled insert power-driven installation tool, after the insert has been installed in a tapped hole, in accordance with the present invention.

As illustrated in FIGS. 1 and 2, the power-driven installation tool 10 of the present invention is attached to a prime mover 42, which is not part of the invention and, therefore, is illustrated in dash lines. The prime mover may be an electric driver, e.g., manufactured by Hios as Model SB 650C. The tool 10 of the present invention comprises a tubular body member 12, a mandrel assembly 14 insertable into the tubular body and adapted to receive a tangless insert, a sleeve member reciprocating in the direction of the longitudinal axis of the mandrel assembly 14, a bearing member 50 at the front of the tubular body and an adjusting means 16 movable along the mandrel assembly 14 wherein the depth to which the insert 11 can be driven is adjustable within certain limits. The tubular body member 12 provides, in part, the operator with a means for supporting the mandrel assembly 14 in order to install the insert correctly during operation. The tubular body member 12 may include wrenching flats 41 for securing the tool 10 while moving the adjusting means 16.

The mandrel assembly 14 is insertable into the tubular body member 12 and is adapted to receive the tangless insert for installation into a tapped hole. The mandrel assembly 14 comprises a cylindrical rod 20 having a shank end adapted to be received in the chuck of the prime mover 42. The lead end 22 of the rod 20, at the end opposite the shank end 24, is threaded and has a diameter according to the inner diameter that insert 11 will have when it is in its contracted state and installed in a tapped hole 15 of the parent material 17. Thus, the diameter of lead end 22 is somewhat smaller than the inner coil diameter of insert 11 prior to the application of the tool.

The sleeve member 18, biased by spring 42 between lip 43 and trailing bias adjustment 44, is closely fitted concentrically about the lead end 22 of the rod 20 to maintain the helix angle of the insert 11 for a smooth transition of the insert into the tapped hole 15. If the sleeve member 18 fits too loosely around the insert or is omitted, then the helix of the insert will flatten out and the insert will not properly engage the first threads of the parent material.

Further, as illustrated in FIGS. 1 and 2, an adjusting means 16 serves as a jamb nut with the end portion 13 of movable tubular body member 12, thereby adjusting the distance that the lead end 22 of the rod 20 may project out of the tubular body member 12, thus defining the proper depth to which the insert 11 may be installed in a tapped hole.

The bearing member 50, generally made of nylon and fitting around the ring 48 on the front portion of the tubular body member 12, bears against the parent material 17 when the insert 11 is installed to the predetermined depth, and increases the friction on the tool wherein the driving torque is automatically reversed and the mandrel is screwed out of the tapped hole.

In FIGS. 1 and 2 the pivotable catch or pawl 30 of the invention is illustrated within a longitudinal cutout 32 of mandrel assembly 14. The cutout 32 generally does not extend through the front end 21 of the rod 20, but is generally equal in length to the pawl 30. The pawl 30 is biased within the cutout 32 so that a hook portion 34 protrudes through aperture 33 and engages the recess 52 of the tangless wire coil insert 11. The pawl is generally biased about pivot point 36 by springs 38 to locate the hook portion 34 into the recess 52 of the insert when the insert is screwed onto the lead end 22 of the mandrel assembly 14.

Figure 3:
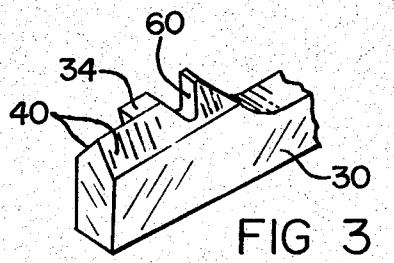
FIG. 3 is a perspective view of the leading end of the pawl of the present invention.

The pivotal pawl 30 further includes lead ramps 40, shown in FIG. 3. The ramp 40 in combination with the truncated end portion 46 of the insert provides a camming means for pivoting the pawl 30 inwardly. Accordingly, the important feature of the pivotable pawl 30 is that it has the ability to locate the hook portion 34, which generally extends between two peaks of the threaded portion of the lead end 22 of the rod, only in the recess of the insert 11 to threadably drive the insert 11 into a tapped hole. Further, counter rotation of the cylindrical rod 20, when the insert has reached its predetermined depth, allows the pivotal pawl 30 to automatically disengage from the recess of the insert to permit extraction of the tool. The ramp 40 provided adjacent but on the opposite side of the centerline of the pivotal pawl 30 permits the recess 52 of the insert 11 to automatically push the pawl 30 downward upon counter clockwise rotation of the cylindrical rod 20, and thus providing an automatic extraction of the tool 10.

The pivotable pawl 30 also has a notch 60 rearwardly adjacent the hook portion 34. This notch 60 captures the inner thread of the next adjacent thread to the lead thread of the insert to prevent the recess 52 of the insert from slipping off the hook portion 34 when rearward axial force is applied to the insert. Thus, this anti-slip-back notch 60 assures engagement of hook portion 34 and the insert.

Figure 4:
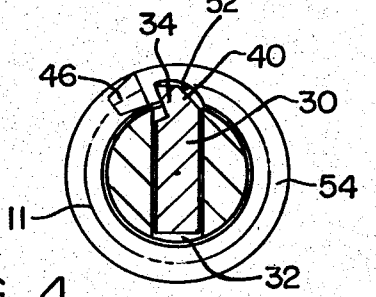
FIG. 4 is a sectional view, with some details omitted, taken along lines 4—4 of FIG. 2.

As illustrated in FIG. 4, the hook portion 34 of the pawl 30 engages the recess 52 of the lead end 54 in order that the insert 11 may be screwed by means of the tool 10 into a tapped hole. Since both free ends of the helical coiled insert have recesses 52 cut therein, the insert may be inserted in the tool in either direction, thus eliminating the possibility of the operator inserting insert on the tool in the wrong direction.

In order to use the tool for driving an insert 11 into a tapped hole, the insert 11 is screwed onto the lead end 22 of the mandrel assembly 14 until the hook 34 contacts the recess 52 of the lead coil. Then the insert is driven into the tapped hole until the bearing contacts the surface of the tapped hole, whereupon the tool automatically reverses out of the insert and the tapped hole. If after an insert has been installed and the tool removed, it becomes necessary to adjust the depth of the insert in the tapped hole, the tool of the present invention may be reinstalled. To reinstall the tool, the ramp portion 40 of the pivotal pawl 30 cooperates with a truncated portion 46 of the free end of the insert 11 to push the pawl 30 in a downward direction. During reinsertion of the tool 10 the pivotal pawl 30 moves along the inner surface of the coil past the truncated portion of the coil, past the recess 52 of the trailing portion of the coil axially along the insert until the hook portion 34 of the pawl again engages the recess at the lead end of the coil.

We claim:

1. A tool for inserting a tangless helically coiled insert in a tapped hole comprising:

a tubular body of substantially circular cross-section;

a mandrel insertable into said tubular body and adapted to receive the tangless insert for installation in the tapped hole, said mandrel including, a driving means at one end, a threaded portion at the opposite end for screwing the tangless coil thereupon, and a pivotable pawl extending longitudinally in a cavity adjacent said threaded portion of said mandrel, adapted to engage a notch in the leading coil of the tangless coil when the tangless coil is threaded onto said mandrel whereby rotation of said driving means causes rotation of said tangless coil into the tapped hole;

a sleeve member reciprocably mounted to said tubular body and concentrically disposed about the lead end of said threaded portion, adapted to maintain the helix angle of the insert while inserting the insert into the tapped hole;

a depth adjusting means threadedly mounted on said threaded portion of said mandrel being positioned for engagement with said tubular body to adjust the axial length of said mandrel within said tubular body; and a bearing means attached to said tubular body at the end opposite said depth adjusting means to limit the friction between the tool and the material around the tapped hole, whereby the driving torque of the tool is automatically reversed at the limiting friction.

2. An installation tool as claimed in claim 1, in which said bearing means is nylon.

* * * * *